US005592755A

United States Patent [19]

Ehrlich

[11] Patent Number: 5,592,755

[45] Date of Patent: Jan. 14, 1997

[54] SHOE SOLE AND PROCESS FOR PRODUCING THEREOF

[75] Inventor: Johann Ehrlich, Krems/Donau, Austria

[73] Assignee: Kastinger Stapa-Schuhfabrik Hans Huemer Gesellschaft m.b.H., Lambach, Austria

[21] Appl. No.: 78,262

[22] PCT Filed: Dec. 23, 1991

[86] PCT No.: PCT/AT91/00140

§ 371 Date: Aug. 17, 1993

§ 102(e) Date: Aug. 17, 1993

[87] PCT Pub. No.: WO92/11779

PCT Pub. Date: Jul. 23, 1992

[30] Foreign Application Priority Data

Dec. 28, 1990 [AT] Austria ..... A2645/90

[51] Int. Cl.[6] ..... A43B 13/08; A43B 1/06

[52] U.S. Cl. ..... 36/33; 36/86; 12/146 B

[58] Field of Search ..... 36/33, 31, 85, 36/86; 12/146 B, 146 BR, 146 BC, 146 BP

[56] References Cited

U.S. PATENT DOCUMENTS

| | | | |
|---|---|---|---|
| 694,872 | 3/1902 | Lockett | 36/33 |
| 2,394,704 | 2/1946 | Loewer | 12/146 B |
| 2,508,392 | 5/1950 | Issazy | 36/33 |
| 4,030,155 | 6/1977 | Azadian et al. | 12/146 B |
| 4,177,582 | 12/1979 | Ehrlich, Jr. | 36/33 |
| 4,290,212 | 8/1981 | Matsson | 36/33 |
| 4,400,894 | 8/1983 | Ehrlich | 36/33 |
| 4,654,915 | 4/1987 | Rigon | 36/33 |

FOREIGN PATENT DOCUMENTS

| | | | |
|---|---|---|---|
| 378898 | 10/1985 | Austria . | |
| 0398869 | 11/1990 | European Pat. Off. . | |
| 996085 | 12/1951 | France . | |
| 308713 | 10/1917 | Germany | 36/33 |
| 3144646 | 12/1982 | Germany . | |
| 3707538 | 9/1987 | Germany | 36/33 |
| 407112 | 8/1944 | Italy | 36/33 |
| 9015549 | 12/1990 | WIPO | 36/33 |

*Primary Examiner*—Ted Kavanaugh
*Attorney, Agent, or Firm*—Salter & Michaelson

[57] ABSTRACT

A shoe sole consists of an upper sole part (1) consisting of wood, and of a running sole (7) found underneath this. The upper sole part (1) is divided in the ball region so that several narrow strips (3) are formed running crosswise to the longitudinal direction of the sole, and the strips are joined together as well as with the front and back sole parts (4, 5) by flexible intermediate pieces (6). In one form of embodiment, a reinforcing layer (8) is rigidly joined on the surface, at least in the region of strips (3) on the under side of upper sole part (1). This reinforcing layer (8) appropriately consists of at least a layer of a wood veneer, which is glued onto the under side of upper sole part (1).

18 Claims, 1 Drawing Sheet

SHOE SOLE AND PROCESS FOR PRODUCING THEREOF

BACKGROUND AND SUMMARY OF THE INVENTION

The invention concerns a shoe sole with an upper sole part consisting of wood, whose upper side, which is preferably orthopedically shaped, forms the support for the sole of the foot, and a running sole made of elastic and flexible material which is arranged beneath the upper sole part, whereby the upper sole part is divided, at least in the ball region, into several strips running crosswise to the lengthwise direction of the sole, and these strips are joined together by flexible intermediate pieces, preferably made of polyurethane foamed onto the wood. Further, the invention concerns a process for the manufacture of such a shoe sole.

Shoe soles with an upper sole part consisting of wood and with a running sole made of elastic and flexible material which is attached to the under side of this upper sole part have been known for a long time. Such shoe soles have the advantage that they have excellent support hygienic properties, since they absorb perspiration and control moisture, and that they support the foot in an orthopedically correct manner, particularly if the upper side of the upper sole part is shaped orthopedically. However, there is the disadvantage in shoe soles, whose upper sole part consists wholly of wood, that its rigidity does not make possible in such shoe soles a bending in the ball region, as is necessary for comfortable walking.

In order to eliminate this disadvantage, it has already been proposed to divide the upper sole part consisting of wood in the ball region and to connect the individual parts by flexible intermediate pieces, particularly of polyurethane foamed onto the wood. The arrangement of several flexible intermediate pieces offers the advantage of a better bendability. In this case, however, the strips found between the flexible intermediate pieces in the longitudinal direction of the sole must be narrow in order to be able to arrange all of the elastic intermediate pieces in the ball region. The longitudinal direction of the fibers of the wood runs usually in the longitudinal direction of the sole in the shoe soles, and the division of the upper sole part into strips thus runs crosswise thereto. Now, if the individual strips are narrow, there is the danger that with an unequal load of the same, the strips will break along the longitudinal direction of the fibers of the wood, thus crosswise to the longitudinal direction of the strips. Such an unequal load will occur, for example, if uneven surfaces are tread upon with the sole. Thus, if one treads upon small stones with the shoe sole, this may cause the breaking of one or more strips.

Therefore, the task of the present invention is to avoid this disadvantage and to form a shoe sole in which the danger of breaking the narrow strips is avoided. A solution to this task according to the invention, proceeding from a shoe sole of the type described initially, consists of the fact that the under side of the upper sole part is joined rigidly on the surface with a reinforcing layer at least in the region of the strips. This reinforcing layer effects a reinforcement of the strips crosswise to the longitudinal direction of the fibers of the wood, as a consequence of the rigid surface combination with the under side of the upper sole part, whereby the danger of breaking is excluded even with nonuniform loading of the sole.

According to a preferred form of embodiment of the invention, the reinforcing layer consists of at least one layer of wood veneer attached, preferably glued, to the under side, of the upper sole part. Frequently a single layer consisting of a wood veneer is sufficient for reinforcement. Sometimes, however, it is appropriate to provide several layers, preferably joined together by gluing, whereby if there is produced a diagonal and crosswise gluing of neighboring layers with respect to the longitudinal directions of the fibers, a plywood is formed, which then forms the reinforcing layer. The use of such a wood veneer or such a plywood has the advantage that a solid surface connection, preferably by means of gluing, can be obtained, which is necessary for producing the aimed-at effect, as a consequence of the uniformity of the materials both for the upper sole part as well as for the reinforcing layer.

With the use of a wood veneer as a reinforcing layer, it is of advantage if the longitudinal direction of the fibers runs perpendicular to the longitudinal direction of the fibers of the upper sole part consisting of wood, at least for one of the layers of wood veneer, since then the reinforcement of the individual strips is produced particularly in any direction in which there is a danger of breaking. If a single layer is provided of a wood veneer, then the longitudinal direction of the fibers of this single layer is to be arranged perpendicular to the longitudinal direction of the fibers of the upper sole part consisting of wood. With the use of plywood, which is formed, for example, from three diagonal and cross-glued layers of a wood veneer, it is appropriate to allow the longitudinal direction of the fibers of the two outer layers to run perpendicular to the longitudinal direction of the fibers of the upper sole part consisting of wood and to allow the middle layer to run crosswise thereto.

However, the reinforcing layer may also consist of a plastic part attached by the surface to the under side of the upper sole part. In the simplest case, the reinforcing layer is formed by a plastic foil glued onto the under side of the upper sole part. However, a hardenable, but not yet hardened plastic material, for example, can be coated onto the under side of the upper sole part, for example, by means of spraying or applying with a spatula, and this forms the reinforcing layer after hardening.

The reinforcing layer may also extend over any region of the under side of the upper sole part, in which the intermediate pieces are arranged. However, it is appropriate, if the surface of the under side of the upper sole part formed by the intermediate pieces does not have the reinforcing layer. In this case, since this is particularly appropriate for a simple manufacture of the sole of the invention, the intermediate pieces and the running sole are formed in one piece, since then the reinforcing layer does not form a separation between the intermediate pieces and the running sole.

Another solution to the task of the invention, proceeding from a shoe sole of the type described initially, consists of forming the strips from at least two parts, whose neighboring front surfaces essentially run in the longitudinal direction of the sole and are also joined together by flexible intermediate pieces. In this way, a shoe sole is formed in which the strips can be bent crosswise to their longitudinal direction, thus as a rule in the longitudinal direction of the fibers of the upper sole part consisting of wood, so that in this case also, the danger of breaking these strips with an uneven load is eliminated. It is appropriate, if all of the intermediate pieces are formed in one piece and are thus joined together, so that a good cohesion is also assured between the individual intermediate pieces, and the manufacture of the shoe sole of the invention is simplified.

The process of the invention for manufacturing the described shoe sole essentially consists of the fact that after a reinforcing layer is rigidly joined on the surface, preferably by gluing or with an adhesive, to the under side of a wood piece forming the upper sole part, at least in the ball region, several cuts are produced in this under side in the ball region, for example, by milling, by means of which in the presence of a reinforcing layer, this is layer fully separated and the wood piece forming the upper sole part is at least partially separated, such that this wood piece, if necessary with the reinforcing-layer segments joined rigidly therewith, is inserted into a mold, that a liquid plastic material, preferably a material forming polyurethane, is introduced hereon in the mold, and solidifies, particularly by foaming out, whereby in the region of the cuts, the intermediate pieces and the running sole thus formed in one piece are formed, and that finally the sole part thus manufactured is removed from the mold. The wood piece forming the upper sole part thus need not have the exact [final] form of the upper sole part, but may also be larger; particularly, it may have a greater thickness measured perpendicularly to the upper side of the sole. In this case it is possible to incompletely separate the wood piece forming the upper part of the sole, while a joining is retained on the upper side, whereby the insertion into the mold is essentially simplified. According to another feature of the process of the invention, after demolding, at least the upper side of the wood piece forming the upper sole part is processed, preferably by milling or grinding, and removing excess material, whereby not only the orthopedic shaping of this upper side can be achieved, but also any region can be eroded in which there is still present a joining of the wood part forming the upper sole part, and thus the intermediate pieces reach to the upper side of the upper sole part.

BRIEF DESCRIPTION OF THE DRAWINGS

The shoe sole according to the invention will be explained on the basis of an example of embodiment shown schematically in the drawing.

DESCRIPTION OF THE PREFERRED EMBODIMENT

Figure 1:
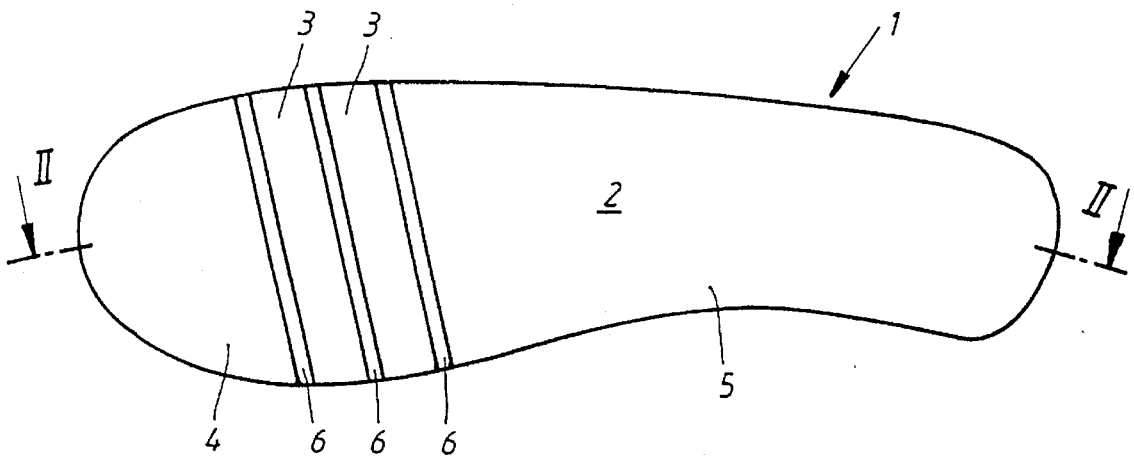
FIG. 1 shows a top view onto a first form of embodiment of the shoe sole of the invention and FIG. 2 represents a section along line II—II in FIG. 1.

The shoe sole of the invention has an upper sole part 1 consisting of wood, whose orthopedically shaped upper side 2 forms the support for the sole of the foot. In the ball region, the upper sole part 1 is divided into several strips 3 running crosswise to the longitudinal section of the sole, and these strips are joined together and to the adjacent sections 4, 5 by flexible intermediate pieces 6. The flexible intermediate pieces 6 preferably consist of polyurethane, which is foamed onto parts 3, 4, 5 consisting of wood, whereby a permanent connection is produced between the wood parts and the flexible intermediate pieces 6.

Underneath upper sole part 1 is found a running sole 7 of elastic and flexible material, which is formed in one piece with intermediate pieces 6 and preferably also consists of polyurethane foamed onto the wood.

Since the bending capacity of the sole must be produced in the ball region, strips 3 must be arranged at least in the ball region. Strips 3 are thus viewed as narrow in the longitudinal direction of the sole, which is visible from the drawing. Since the longitudinal fibers usually run in the longitudinal direction of the sole in wood soles, with an uneven loading of the sole, for example as occurs on walking on uneven ground, there is the danger that the strips break along a longitudinal fiber. In order to eliminate this danger, in the form of embodiment according to FIGS. 1 and 2, a reinforcing layer 8 is joined rigidly to the surface of the strips on the under side of the strips. As a result of the simplification of manufacture of the shoe sole of the invention, since this reinforcing layer 8 is preferably introduced before the upper sole part 1 consisting of wood is separated in order to form the intermediate spaces which take up the intermediate pieces 6, it is appropriate if this reinforcing layer is extended at 8' also over a region of approximately 1 cm beyond the limiting part of the upper front sole part 4 and the upper back sole part 5, since in this case it is assured that, in any case, after the manufacture of the intermediate spaces taking up intermediate pieces 6, the lower sides of strips 3 are completely covered by reinforcing layes. Reinforcing layer 8 may also extend, however, proceeding from the tip of the sole, over the entire under side of the upper front sole part.

In a particularly advantageous form of embodiment, reinforcing layer 8 is formed of at least one layer of wood veneer glued onto the under side of the upper sole part. Frequently, a single such layer is sufficient. If several layers of a wood veneer glued together are provided, then these are glued preferably diagonally and crosswise with respect to the longitudinal direction of their fibers, so that a plywood is formed. With the use of a single layer of a wood veneer, the longitudinal direction of the fibers of the same will run crosswise to the longitudinal direction of the fibers of the upper sole part 1 consisting of wood. In case a plywood is used, it is of advantage if at least the longitudinal direction of the fibers of some of the layers of wood veneer, and, in fact, preferably the outer layers of wood veneer, run perpendicularly to the longitudinal direction of the fibers of the upper sole part 1 consisting of wood.

Reinforcing layer 8, however, may also be formed by a plastic foil attached by adhesive to the under side of the upper sole part 1 or may be formed of a plastic material which can be hardened and is introduced onto the under side of the upper sole part, for example, by applying with a spatula or spraying. Finally, it is possible to form reinforcing layer 8 of a textile material, preferably reinforced with plastic, and attached to the under side of the upper sole part. This textile material may consist, for example, of a non-woven fabric, which is impregnated with plastic material. A plastic material may find use, which is softened by the introduction of heat, so that reinforcing layer 8 consisting partially of a plastic material may then be adapted to the shape of the under side of upper sole part 1 and retains this form after cooling. Glass fibers are preferably used as the base material for the textile material.

In the manufacture of the sole of the invention, it is appropriate to start with a wood piece whose thickness, measured perpendicularly to the upper side of the upper sole part 1, is greater than the thickness of the upper sole part of the finished sole. After producing the rigid surface connection between reinforcing layer 8 and this wood piece, the wood piece is separated only partially in those places where the intermediate pieces are arranged with respect to reinforcing layer 8 joined therewith, proceeding from this reinforcing layer, so that on the side lying opposite the reinforcing layer, the wood piece remains joined. In this way, the insertion into a mold is simplified, in which the intermediate pieces 6 and the running sole 7 are formed by introducing an elastic and flexible material. After demolding, part 9 in the region of upper side 2 of upper sole part 1, depicted in FIG.

2 by the broken line, is removed by milling or grinding, so that then intermediate pieces 6 reach to upper surface 2, and the necessary bending capacity is provided. Although an embodiment is shown in FIG. 2, in which the entire upper surface 2 of the upper sole part 1 is processed after demolding, it is also possible to endow the final shaping to the back part of the upper side of upper sole part 1 and to only process the front part of upper side 1 of upper sole part 1 after demolding, and in this way to remove any part of the wood, so as to uncover the intermediate pieces 6.

Figure 2:
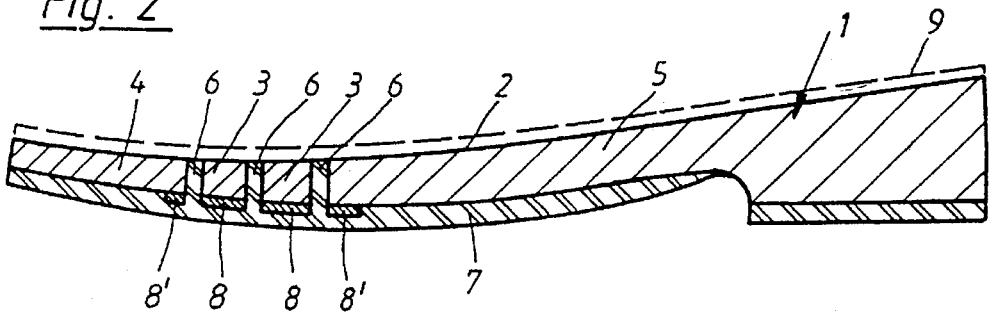
Figure 3:
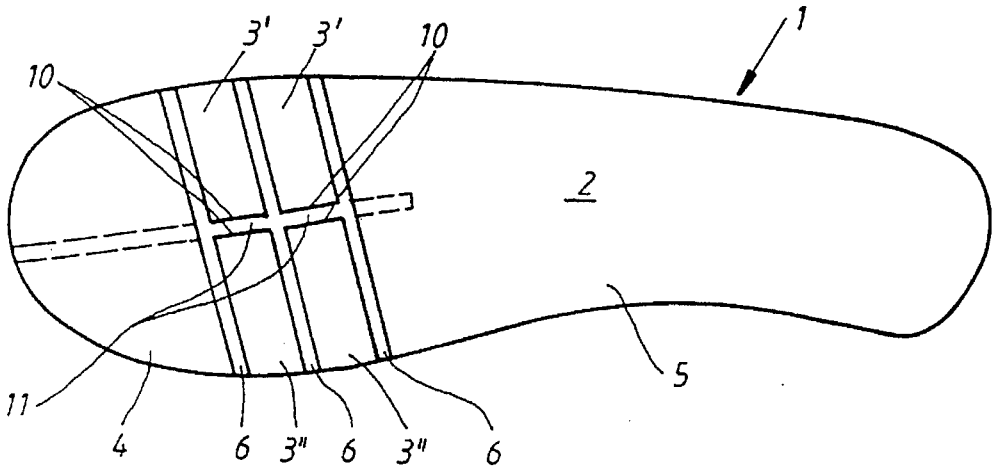
FIG. 3 shows a top view of a second form of embodiment of the shoe sole of the invention.

The form of embodiment according to FIG. 3 is distinguished from the form of embodiment according to FIGS. 1 and 2 by the fact that reinforcing layer 8 is omitted. In order to eliminate the danger of breaking of strips 3, in this form of embodiment, strips 3 consist of at least two parts, 3, 3", whereby the division runs essentially in the longitudinal direction of the sole. The front surfaces 10 of individual parts 3', 3" which are adjacent to each other are also joined together by flexible intermediate pieces 11, which operate such that the strips can bend crosswise to their longitudinal direction, so that in this case a breaking of the strips is prevented. Flexible intermediate pieces 11 may be arranged only in the region of strips 3, but also beyond the strips; for example, they can extend up to the tip of the sole, as is indicated by the broken line in FIG. 3. In this case, the production of the shoe sole is simplified.

All intermediate pieces 6, 11 are preferably formed in one piece so that a good cohesion is assured and manufacture is simplified. The production of the shoe sole shown in FIG. 3 proceeds in the same way as the production of the shoe sole shown in FIGS. 1 and 2, with the difference that the introduction of reinforcing layer 8 is dispensed with; thus only upper sole part 1, proceeding from the under side of the same, is partially separated for the formation of intermediate spaces, which take up intermediate pieces 6, 11, so that even here a joining of the wood piece can remain on the side laying opposite the under side, before this is inserted into the mold.

What is claimed is:

1. A shoe sole comprising an upper sole part comprising wood, said upper sole part having an upper side which forms a support for a sole of a foot and further having an underside, said shoe sole further comprising a running sole of elastic and flexible material arranged underneath said upper sole part, said upper sole part having a ball region which is divided into a plurality of strips running crosswise to a longitudinal direction of said shoe sole, said strips being joined together by flexible intermediate pieces, said shoe sole further comprising a reinforcing layer which is rigidly joined to the under side of said upper sole part in the ball region thereof.

2. In the shoe sole of claim 1, said upper sole part being orthopedically shaped.

3. In the shoe sole of claim 1, said flexible intermediate pieces comprising polyurethane.

4. In the shoe sole of claim 1 said reinforcing layer comprising at least one layer of wood veneer attached to the under side of said upper sole part.

5. In the shoe sole of claim 4, said upper sole part having wood fibers running in the longitudinal direction of the sole, said at least one layer of said wood veneer having wood fibers which run perpendicular to the longitudinal direction of the wood fibers of the upper sole part.

6. In the shoe sole of claim 1, said reinforcing layer comprising a plastic layer which is attached to the under side of the upper sole part.

7. In the shoe sole of claim 6, said plastic layer comprising a plastic foil.

8. In the shoe sole of claim 6, said plastic layer comprising a hardenable plastic material.

9. In the shoe sole of claim 1, said reinforcing layer comprising a textile material attached to the under side of said upper sole part.

10. In the shoe sole of claim 9, said textile material being reinforced with plastic.

11. In the shoe sole of claim 1, said reinforcing layer being rigidly attached only to the under side of said wood strips and said under side of said wood upper sole part.

12. A shoe sole comprising an upper sole part comprising wood, said upper sole part having an upper side which forms a support for a sole of a foot and further having an underside, said shoe sole further comprising a running sole of elastic and flexible material arranged underneath said upper sole part, said upper sole part having a ball region which is divided into a plurality of strips running crosswise to a longitudinal direction of said shoe sole, said strips being joined together by first flexible intermediate pieces, said strips being divided into at least two parts whose front surfaces adjacent to one another run substantially in the longitudinal direction of the sole, said strip parts being joined together by second flexible intermediate pieces.

13. In the shoe sole of claim 12, said upper sole part being orthopedically shaped.

14. In the shoe sole of claim 12, said flexible intermediate pieces comprising polyurethane.

15. In the shoe sole of claim 12, said first and second flexible intermediate pieces being formed as an integral unit.

16. In the shoe sole of claim 12, said first and second flexible intermediate pieces and said running sole being formed as an integral unit.

17. A process for the production of a shoe sole comprising the steps of:

rigidly joining a reinforcing layer in a ball region on an underside of an upper sole part consisting of wood;

producing a plurality of cuts in the ball region on the underside of said upper sole part, said cuts running crosswise to a longitudinal direction of said sole, said cuts extending through said reinforcing layer and substantially through said upper sole part wherein said upper sole part remains at least partially joined by wood material on an upper side of said upper sole part;

introducing said upper sole part into a mold;

introducing a flexible liquid plastic into said mold so as to form flexible intermediate pieces in said cuts and to form a flexible running sole arranged on the under side of said upper sole part;

allowing said plastic to solidify whereby said flexible intermediate pieces and said running sole comprise an integral unit; and removing said sole from said mold.

18. The process of claim 17 further comprising the step of removing said wood material on said upper side of said upper sole part so as to form strips of wood material which are joined by flexible intermediate pieces.

* * * * *